United States Patent [19]

Fisher, Jr. et al.

[11] Patent Number: 4,789,351

[45] Date of Patent: Dec. 6, 1988

[54] BLIND MATING CONNECTOR WITH SNAP RING INSERTION

[75] Inventors: Robert L. Fisher, Jr., Hummelstown; George W. Michael, III, Harrisburg, both of Pa.

[73] Assignee: AMP Incorporated, Harrisburg, Pa.

[21] Appl. No.: 187,717

[22] Filed: Apr. 29, 1988

[51] Int. Cl.[4] ..... H01R 13/64

[52] U.S. Cl. ..... 439/248; 439/555

[58] Field of Search ..... 439/246–248, 439/252, 374, 380, 381, 552–558, 744, 745

[56] References Cited

U.S. PATENT DOCUMENTS

| | | | |
|---|---|---|---|
| 3,091,748 | 5/1963 | Takes et al. | 439/248 |
| 3,094,364 | 6/1963 | Lingg | 439/247 |
| 4,112,282 | 9/1978 | Piber | 439/555 |
| 4,156,804 | 5/1979 | Piber | 439/555 |
| 4,227,765 | 10/1980 | Neuman et al. | 439/248 |
| 4,426,127 | 1/1984 | Kubota | 439/609 |
| 4,580,862 | 4/1986 | Johnson | 439/248 |
| 4,697,859 | 10/1987 | Fisher, Jr. | 439/246 |
| 4,702,707 | 10/1987 | Hillbish | 439/745 |

FOREIGN PATENT DOCUMENTS

| | | | |
|---|---|---|---|
| 2360359 | 6/1975 | Fed. Rep. of Germany | 439/552 |
| 2128038 | 4/1984 | United Kingdom | 439/246 |

OTHER PUBLICATIONS

IS 9333, released 8-3-87, Amp Inc.; Hbg, PA 4 pages.

*Primary Examiner*—Gary F. Paumen

[57] ABSTRACT

An electrical connector (10) comprised of intermating halves (12, 80) including snap rings (58, 150), a shroud (50) and sleeve (140) of geometries allowing blind-mating of the connector halves with both halves being readily snapped into block apertures (68, 130) of housings with sufficient axial float to assure proper mating with varying parts tolerances, and with the snap rings not bound by an axial spring element (106) employed to take up such tolerance.

9 Claims, 4 Drawing Sheets

BLIND MATING CONNECTOR WITH SNAP RING INSERTION

FIELD OF THE INVENTION

The present invention relates to intermating connectors of a type intended to be blind-mated and particularly to connectors which are panel- or housing-mounted in multiple, the mating of which is effected through displacement of the mountings creating possibilities of misalignment and/or introducing the variabilities of different tolerances in different parts.

BACKGROUND OF THE INVENTION

U.S. Pat. No. 4,697,859, issued Oct. 6, 1987, to R. L. Fisher and entitled "Floating Coaxial Connector" explains the need for precision in connectors which provide reliable, noise-free transmission of electrical signals in the higher frequency ranges and the difficulties of mating such connectors when they are mounted in panels in multiple and must in effect be "blind-mated". This background patent also explains the need to have the connectors "float" so as to align themselves for intermating when used in panels or in connector housings which are themselves brought together to effectively connect transmission paths or separated to disconnect such paths. The Fisher patent teaches a connector construction which allows for axial float in one half of the connector and includes as well the teaching of the use of a snap ring allowing such connector half to be plugged into a panel aperture and retained thereby. Details are taught which explain how axial misalignment or radial misalignment of one or the other halves of the connector or of the housing blocks or panels in which the connector halves are mounted can be accommodated while still maintaining a precision interconnection geometry and minimum discontinuities.

Experience with panel-mounted connectors in general and with the type of structure taught in the aforementioned Fisher patent have revealed a number of shortcomings, including difficulty in inserting connector halves having snap rings due to jamming of the snap rings on occasion and to inordinate axial forces required to further compress the compression spring utilized to allow axial float of the connector half in use. A study of this problem has revealed that the resilient means typically is a coil spring which in bearing upon the snap ring causes it to jam in a position so as not to radially collapse during insertion of the connector half. Furthermore, attempts to expand the use of snap rings as a method of assembly of connector halves into a housing or panel has found that the necessary "slod" caused by use of the snap ring in both halves of a mated connector, itself causes stubbing and jamming during mating.

Accordingly, it is an object of the present invention to provide a connector assembly wherein both halves are provided with snap rings and associated structure allowing both halves of the connector to be mounted through the use of snap rings, by hand and without special tooling. It is a further object to provide a connector which has axial float to accommodate axial variations in use with connector housings and panels wherein multiple connectors are intermated. It is a specific object of the invention to provide a novel snap ring assembly which precludes binding of snap rings during insertion of a connector half caused by resilient spring mechanisms intended to allow for connector float. It is a final object of the invention to provide a novel shroud structure for a coaxial connector which provides an easier assembly of parts and insertion and mounting in a housing or block.

SUMMARY OF THE INVENTION

The present invention provides a connector having plug and jack halves which are intermated to join transmission cable. Each of the halves includes a snap ring assembly and mechanism which allows each of the halves to be mounted into a housing, or panel, by hand and through the simple act of pushing the parts of a given half into the aperture of such housing or panel. Both halves of the connector are rear-mounted and mountable with respect to the housing. Both of the halves include flange elements which engage the rear surfaces of such housing proximate the apertures therein to limit axial displacement of the halves. The plug half of the connector is locked to the housing into which it is mounted by virtue of such flange and in conjunction with a shroud member locked to the forward end of such half by a snap ring suitably tapered to allow the shroud to be inserted thereover. The jack half of the connector is made axially displaceable having a resilient element in the form of a coiled spring which biases such jack half forwardly relative to the housing to accommodate tolerance variations in parts and still maintain an intimate end butting contact with the opposite connector half. The end of the resilient member is made to bear against the flange of a sleeve element which includes a geometry defining a recess housing a snap ring and prevents the load of the resilient member from bearing against such snap ring and causing it to bind during insertion of the connector half within its housing. Such sleeve element includes, at an opposite end, the flange which limits axial displacement of the jack half forwardly in its housing.

The shroud on half of the connector is made longer than the plug half so as to engage the aperture of the opposing and mating housing and align the plug half for insertion within the jack half allowing blind mating of the two halves and mating of multiple connectors wherein tolerance variations either in the connectors or in the panels in which they are mounted must be accommodated for effective mating.

Both connector halves may be disassembled through the use of a simple tubular tool element inserted within the connectors or therearound to depress the snap rings radially inwardly and allow disassembly and removal of the connector halves. The advantages of the invention in its application to connectors of all types, including both high-frequency RF-type coaxial connectors and optical signal connectors, both requiring precise alignments and precise intermating of critical parts, should become more apparent with the following detailed description of a preferred embodiment of the invention.

DETAILED DESCRIPTION OF THE INVENTION

Figure 1:
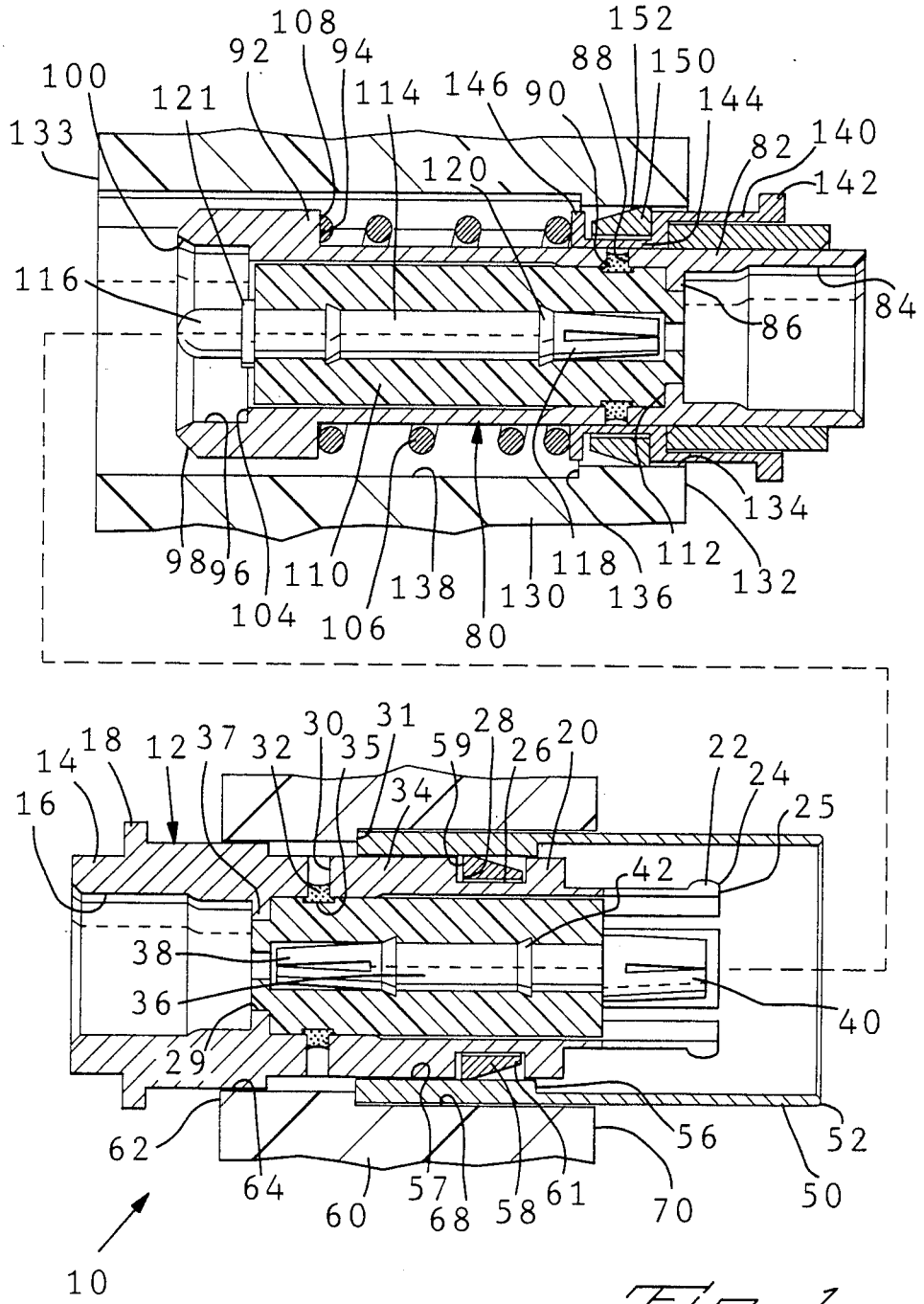
FIG. 1 is a section of the connector of the invention showing both halves relative to housings, in section and partially assembled to show the snap-in feature of one half.

Referring first to FIG. 1 and to a preferred embodiment of a 2.8 millimeter coaxial connector employed the features of the invention in a "blind-mate" application, the connector is shown as 10 comprised of a plug half 12 and a jack half 80 mounted respectively in housings 60 and 130 in the view of FIG. 1. The halves are unmated each with the other and are depicted prior to being fully seated within the housings, but with the halves partially inserted in apertures within such housings. The housings 60 and 130 shown in section and only in part in FIG. 1, may be taken to be wall sections of either panels which can contain a plurality of connectors like 10, or a section through a rear wall of a connector containing a plurality of connectors 10 and in addition, other connectors for power and ground. Not shown, but understood to be included, would be features mounted on or forming part of the housings including mechanical fasteners adapted to align the housings for mutual closure to effect an interconnect of the connector halves.

The plug half 12 of connector 10 includes a body 14 suitably formed as by screw machining out of a conductive metallic stock such as brass suitably finished as by being plated to include a central bore denominated 16 in FIG. 1. The entry into bore 16, to the left in FIG. 1, is configured to facilitate insertion of a stripped and prepared coaxial cable, not shown in the FIG.. Reference may be had to the aforementioned U.S. Pat. No. 4,697,859 which depicts coaxial cable inserted into coaxial connectors. Exteriorly of the connector body 14 is a flange 18 which is dimensioned to serve as a stop against axial displacement by engagement with the edge shown as 62 in FIG. 1 proximate the aperture 64 in block 60.

Figure 3:
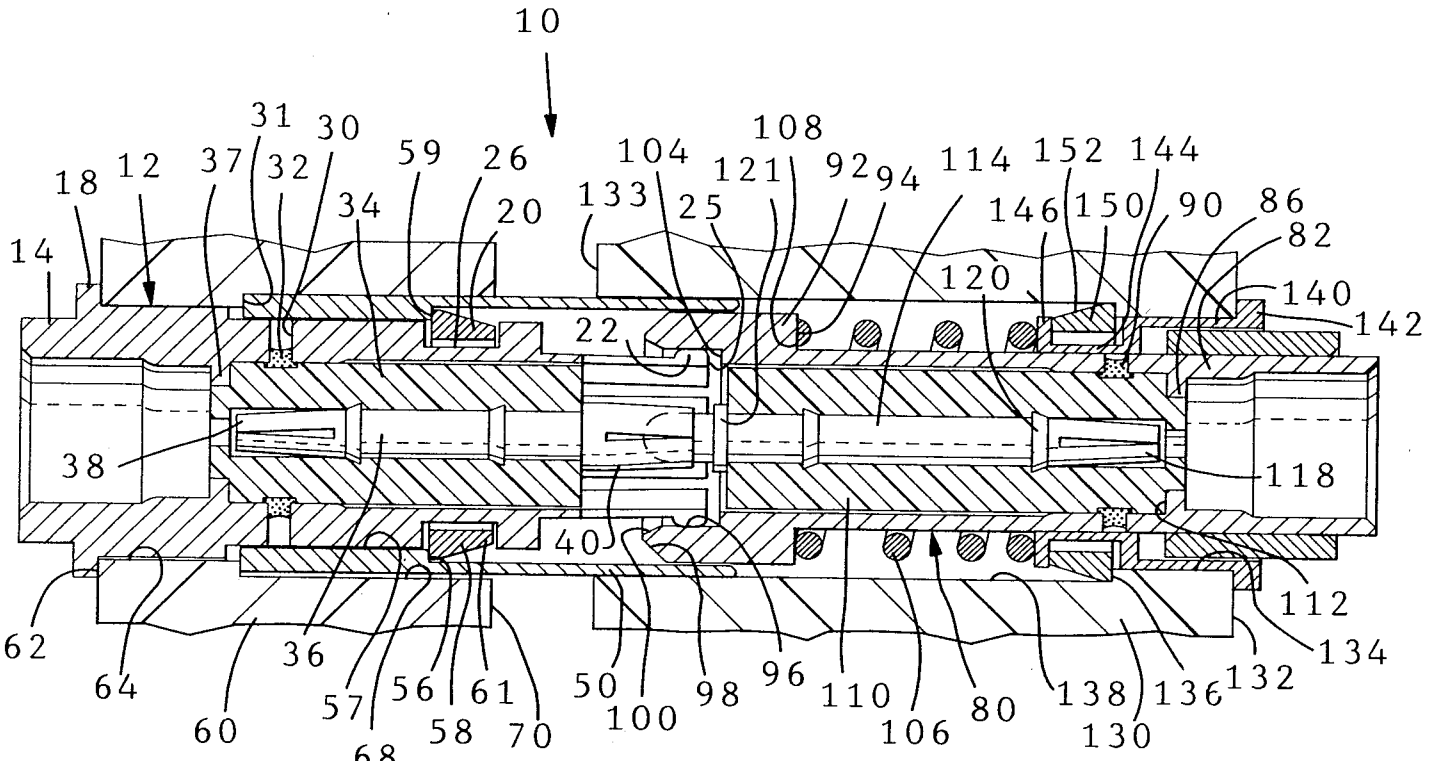
FIG. 3 is a view of the connectors as shown in FIG. 2, but fully mated with one condition of assembly tolerance.
Figure 4:
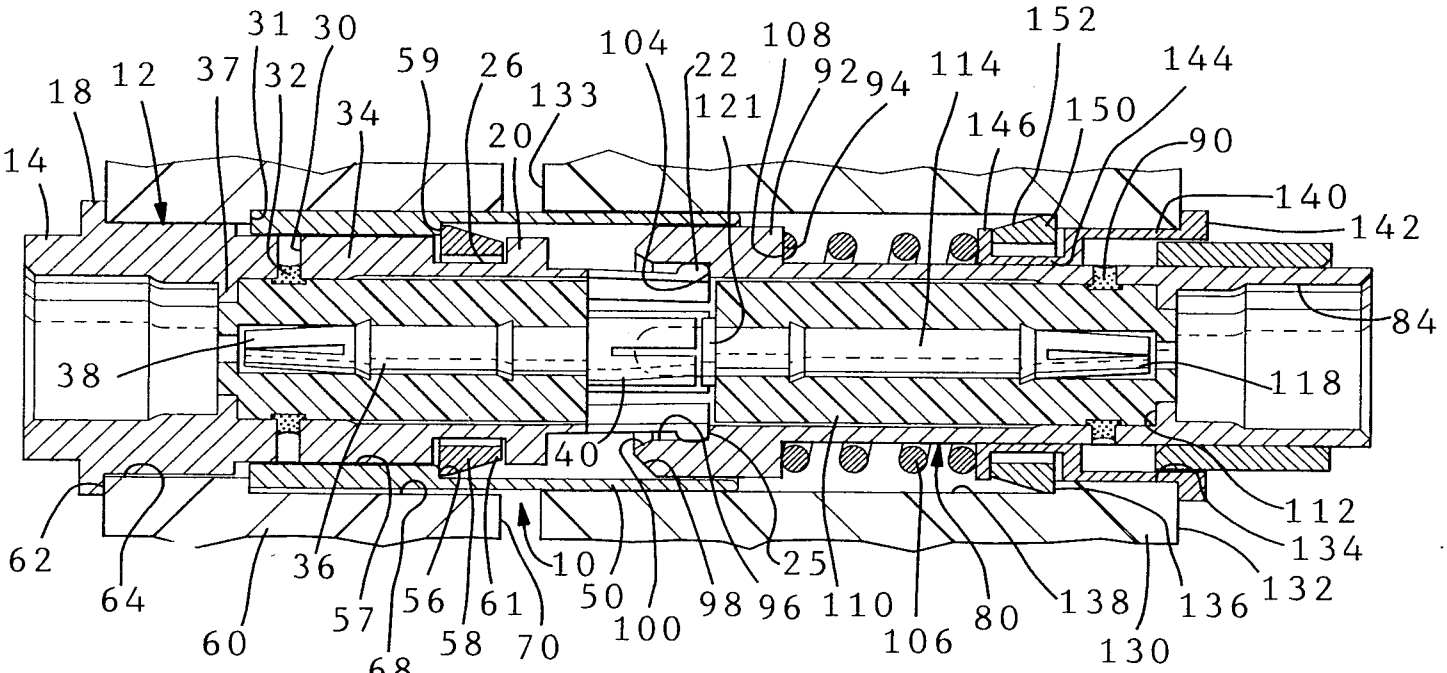
FIG. 4 is a view of the assembly of FIG. 2 with connector halves fully mated, but with an alternative condition of tolerance reflected by the position of the parts.

At the opposite end of connector half 12 and the body 14 thereof from the flange 18 and cable entry area, the body includes an enlarged portion shown as 20 and an end portion shown as 22 formed into spring fingers rounded at the ends thereof as at 24. The spring fingers 22 serve to provide a resilient contact force engaging the inner aperture of the forward end of connector half 80 as is shown in FIGS. 3 and 4.

Body 14 includes midway of the ends, a recess 26, including a radial surface 28 which serves to limit axial movement of the body 14 outwardly of the housing aperture through cooperation of means to be described.

Also shown in FIG. 1 are a series of apertures 30 extending radially through body 14 and into which has been injected an epoxy shown as 32 which serves to lock into place a dielectric sleeve insert shown as 34 within the body 14. The insert is shown as relieved as at 35 to allow the epoxy to lock the insert against displacement outwardly of the connector body. The connector body includes interiorly a flange shown as 29 which cooperates with a reduced end portion of 34 shown as 37 to both resist axial displacement of the insert to the left of body 14 and provide interiorly a guiding path for insertion of the central conductor of a coaxial cable within the connector half. Just to the left of such cable entry is a center contact shown as 36 suitably machined of a conductive material such as brass and suitably plated to include a series of spring fingers shown as 38 which receive and contact the cable center conductor when inserted into the connector half. Also included are a series of barbs shown as 42 which hold the center contact 36 within the dielectric sleeve 34 and thus within the connector half. Opposite to the spring fingers 38 are spring fingers shown as 40 which serve to engage and contact the center conductor pin member 116 of half 80.

Disposed over the forward end of connector half 12 is a shroud shown as 50 formed of conductive metallic material such as brass. The shroud 50 includes, at a leading end 52, a beveled portion to facilitate entry into the aperture 138 of block 130, and at the other end thereof, a geometry dimensioned to engage the end face 31 of a step in the block aperture 62. Interiorly of shroud 50 is a radial surface shown as 56 and a bore shown as 57 dimensioned to fit tightly over the exterior surface of the body 14 of connector half 12.

Fitted within the recess 26 within the body of 14 is a snap ring shown as 58 which has a relaxed diameter relative to the diameter of the recess 26 to allow for compression within such recess and assure expansion out of such recess to present an edge surface shown as 59 engaging the interior radial surface 56 of shroud 50. The forward edge of snap ring 58 is tapered as at 61 to facilitate insertion of shroud 50 over half 12 in the manner shown in FIG. 2.

In practice, the half 12 is inserted within the aperture 64 of housing 60 and seated with the flange 18 against the face 62 of the housing and held there, the coaxial cable having previously been installed in half 12. Thereafter, shroud 50 is inserted from the front end of the housing and driven inwardly to cam snap ring 58 within recess 26, past such snap ring and become seated within the forward portion of the aperture shown as 68. Thereafter, the snap ring 58 expands outwardly, locking shroud 50 to the body 14, and in turn, locking the body 14 within the aperture 64 of housing 60. The outer dimension of shroud 50 is as close to the dimension of the aperture portion 68 as is consistent with metal forming and plastic molding practices so as to provide support against radial displacement, cocking of the half 12 relative to block 60.

As can be appreciated from the foregoing description, the connector half 12 can be readily hand-assembled in the field without the use of special tools, or even indeed, the use of pliers, screwdrivers, wrenches, and the like. With the increasing use of precision coaxial connectors in a wide variety of communications and data applications in the field as contrasted to in the laboratory, rapid and effective assembly is becoming more important.

Referring now to the jack half of the connector 10 references again made to FIG. 1. There, the jack half shown as 80 is made to include a body 82 suitably formed of conductive metallic material such as brass, and made to include an inner bore shown as 84 shaped to accommodate the insertion of a coaxial cable, not shown. The interior of body 82 includes a flange 86 which serves the function of flange 29 previously described. The apertures 88 are made to contain an epoxy material 90 which serves to lock the dielectric sleeve 110 of half 80 in the manner heretofore described with respect to the plug half of the connector.

The forward end of the jack half 80 includes an enlarged portion shown as 92 which has a radial surface 94, the purpose of which will be described hereinafter. The portion 94 includes an interior bore 96 dimensioned to receive in sliding and contacting engagement, the spring finger elements of plug half 10 in engagement with the contact points shown as 24. At the end of portion 92 of body 82 are tapered surfaces 98 and 100 which facilitate insertion in the mating of the connector halves. The surface 98 operates to guide and center the plug half during insertion within the shroud 50 of connector half 12, and the surface 100 serves to aid in the insertion and guide the spring finger elements 22 within the bore 96 of plug half 80. As shown in FIGS. 3 and 4, the end surfaces shown as 25 and 104 interiorly of the connector 10, to the extent possible with practical manufacturing tolerances of the parts. Closure of the end surfaces 25 and 104 are particularly critical to assure against leakage of RF energy and discontinuities caused by radial air gaps in the path of transmission of signal energy within the connector.

Contained on plug half 80 is a resilient means in the form of a coil spring in this embodiment shown as 106, the ends of which are flattened as at 18 to bear against radial surfaces including at one end, the surface 94 heretofore mentioned.

Interiorly of the body 82 is provided a dielectric insert 110 having at one end thereof, a step shown as 112 which serves to limit axial displacement to the right of the connector, and in conjunction with the heretofore mentioned use of epoxy 90, lock the dielectric sleeve within half 82. Contained within the sleeve and mounted therein is a contact pin element 114 having at one end the contact shown as 116 intended to mate within the spring fingers 40 of half 12, and at the other end, spring fingers itself shown as 118 intended to mate with the center conductor of a coaxial cable inserted within connector half 82. The pin member 114 includes barbs 120 adapted to lock the pin against a displacement to the right as shown in FIG. 1, and a flange 121 which serves to limit displacement in the opposite direction.

Jack half 80 is contained within a housing 130, the rear face of which is shown as 132, and the forward face is shown as 133. There is an aperture 134 within the housing which includes interiorly thereof, a radial surface 136 and an enlarged bore 138 of a diameter to receive and support the shroud 50 of half 12. Seated within the aperture 134 is a sleeve 140 which includes a radial flange 142, viewing the right hand side of the several figures which serves to limit movement axially to the left of the drawing figures. The sleeve includes a recessed portion of lesser diameter shown as 144 which joins a further radial flange 146 and serves to captivate a snap ring shown as 150 which includes a tapered forward face 152 and which, in its relaxed diameter, extends out of the recess 144 of the sleeve member. The outer edge of the snap ring 150 seats, in its relaxed condition, against the radial face 136, and in its compressed condition, fits down within the recess 144.

Figure 2:
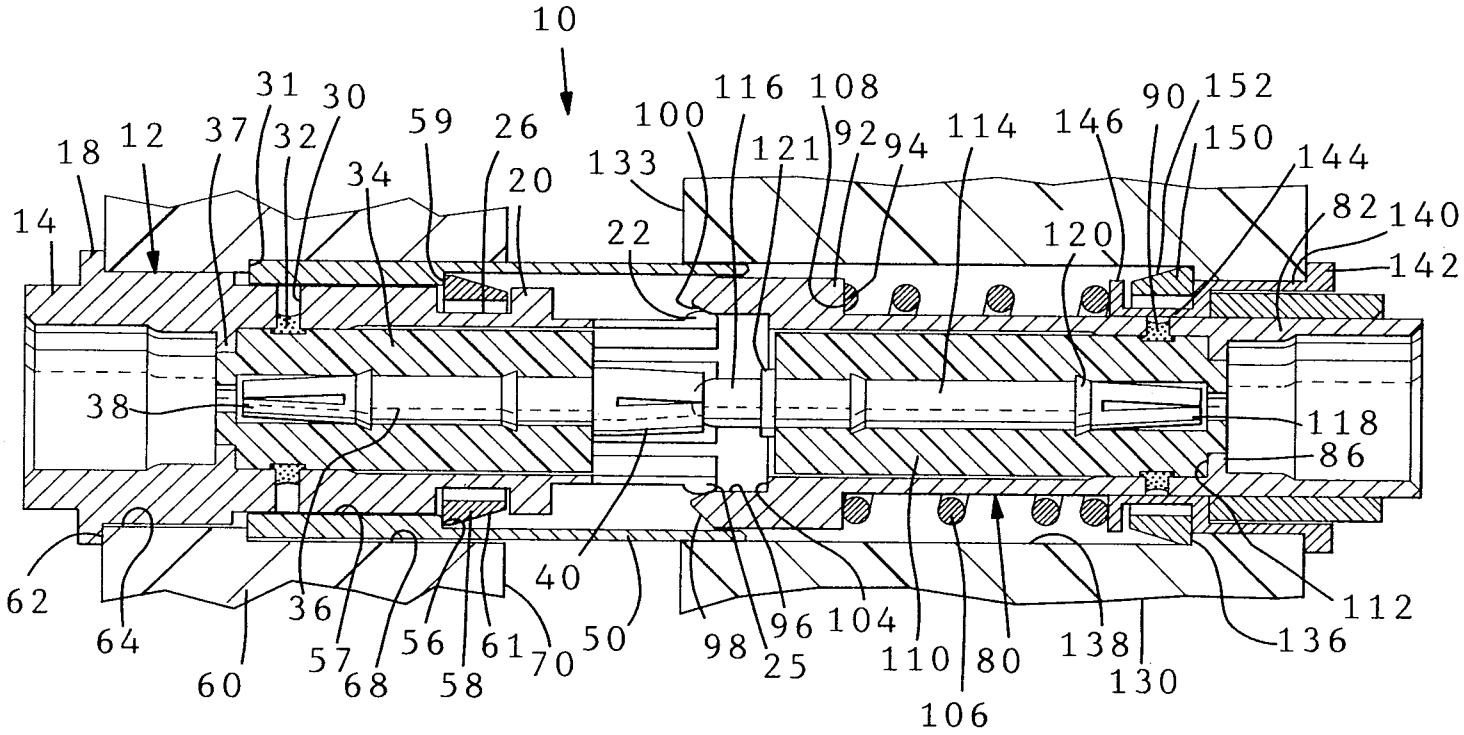
FIG. 2 is a sectional view of the connector of the invention with the connector halves snapped in place and with the connectors positioned in their housings at a point of first engagement for mating.

FIG. 2 shows the connector halves 12 and 80 fully inserted, from the position shown in FIG. 1 to allow the snap rings to be displaced inwardly and then outwardly in a radial sense to captivate the appropriate elements Thus, with respect to connector half 12, the snap ring shown as 58 in FIG. 2 is displaced outwardly to lock the shroud 50 to the body 14 of connector half 12 and thus lock the connector half 12 into position within housing 60. The snap ring 150 is displaced outwardly to lock half 80 in place by direct engagement with the housing 130, particularly radial surface 136. At this juncture, the shroud 50 supports half 12 along center line extending out from housing 60 and the sleeve member 140 supports half 80 extending along the center line of the aperture of housing 80. The end portions which are beveled, 98 and 100, facilitate insertion of the jack half within the shroud 50 of half 12 and the plug half ends 22 within the bore 96, the beveled surface 102 guiding the plug within the jack half. These beveled surfaces on the ends of the halves 12 and 80 take care of radially differing dimensions and tolerances between the two halves. Axial differences are accommodated by virtue of the telescoping characteristics of the plug half biased by the resilient means coil spring 106. This is best shown in FIGS. 3 and 4 which represent different axial spacings between the surfaces 70 of housing 60 and 133 of housing 130 and show the reaction of the elements in such circumstance. Note that in both conditions of mating that the end of the plug half 12 denominated 25 is in engagement with the radial surface 104 of the jack half 80. This is caused by the bias of the resilient means, coil spring 106 pressing the jack half forwardly against the reaction of the outward end of the spring against flange 146 of sleeve 140. Sleeve 140 is held against further displacement by engagement-with the snap ring 150.

In practice, the halves 12 and 80 may be removed from their respective housings by depressing the snap rings inwardly. This can thus be accomplished by the use of a tool in the form of a thin wall metal cylinder of a diameter to fit within the shroud 50 and engage the snap ring 58; or, in the case of the half 80, a similar cylinder but of a dimension to fit within the bore 138 and engage the snap ring 150.

The use of the shroud structure in conjunction with the snap ring is shown relative to connector half 12 is in and of itself a substantial advantage to locking the half 12 in place through a minimal and reliable mechanical structure which can be field-installed. The advantage afforded by the use of sleeve 140 in conjunction with its features and snap ring 150 is that the snap ring is allowed to expand or contract freely within the recess 144 despite the axial force of the resilient means, coil spring 106 which is precluded from pressing against and binding such snap ring during insertion of the connector half 80 within its appropriate aperture. This allows a bias for the resilient means effected by making the coil spring longer than the distance between radial surface 108 and the end surface adjacent flange 146 of the sleeve.

While the present invention has been detailed relative to a specific coaxial connector for the interconnection of a transmission path for RF energy, the features utilized in the several halves may be employed to advantage with other types of connectors, including the so-called optical connectors which interconnect optical fibers and which require precision as well as field installation and ease of use with minimum tooling. So too with respect to the use of the sleeve member in conjunction with the snap ring which precludes binding up due to the resilient means, coil spring 106.

Having now disclosed and described my invention in terms intended to enable a preferred practice thereof, I set forth what I claim is inventive as follows:

1. A connector of a type having a first connector half retained within an aperture in a housing for mating with a further connector half said connector halbes each having at least one conductive contact therein characterized in that the said first connector half includes resilient means adapted to bias said first half axially in said aperture to accommodate for positional and manufacturing dimensional differences and assure proper mating between the two connector halves and further characterized in that said first connector half includes a tapered snap ring adapted to engage edges of said housing within said aperture to allow said first half to be inserted into said block, the improvement comprising, sleeve means carrying said snap ring therearound with said sleeve means having a flange adapted to engage an edge of said aperture and limit movement of said first half in said housing in one direction, and further having a second flange adapted to engage said resilient means disposed within said aperture operable to bias said first half axially in an composite direction whereby axial forces are precluded from binding said snap ring against radial displacement during insertion of said first half in said housing said racial displacement preventing removal of said first half from said aperture

2. The connector of claim 1 wherein said sleeve means includes a recess dimensioned axially and radially to accommodate said snap ring in radial displacement during insertion of said first connector half within said aperture.

3. A connector of the type having a first half for mating with a further connector half mounted within an aperture of a housing characterized in that the said further connector half is fixed in said further housing against axial movement during mating with said first connector half, and further characterized in that said further connector half includes a body having an annular groove therein and a tapered snap ring fitted within said groove for radial displacement, said body having a flange adapted to engage an edge surface said aperture to limit axial movement of said further connector half in one direction shroud means fitted over said further connector half body including an outer radial surface adapted to engage an internal radial surface within said aperture to limit movement of said connector body in the other direction and having an interior radial surface adapted to be engaged by said tapered snap ring as said shroud is axially displaced over said body to lock said shroud to said body and to lock said connector half to said housing.

4. The connector of claim 3 wherein said shroud extends forwardly of said housing in an axial sense beyond said body to serve in aligning the said first half of said connector during mating with the said further half of said connector.

5. A connector having first and second halves adapted to intermate and interconnect signal paths, housing means for housing said connector halves each having an aperture therein and each aperture including exterior radial edge surfaces and interior radial edge surfaces, each said connector half having a tapered snap ring adapted to be radially displaced about said half, each said connector half having a radial surface adapted to engage the external radial surface of a given housing to limit movement of said half relative to said housing in one direction and each said half having further means including a radial surface interiorly of said aperture adapted to engage said snap rings to preclude movement of said halves relative to said ho in another direction, said second connector half including a resilient spring means to bias said half axially to effect end engagement of the said halves and preclude variations and impedance discontinuities due to tolerances and means on said second half to preclude binding of the said snap rings against radial collapse during insertion of said one half into said housing.

6. The connector of claim 5 wherein the said first connector half includes a shroud extending axially beyond the end of said first half to engage the aperture of the housing of the said second half prior to the engagement of the said first half with the said second half during mating to effect alignment.

7. A coaxial connector of a type utilized in plural to interconnect high frequency signal paths requiring precise impedance matching between connector halves, said connector comprising intermating plug and jack connector halves each carried in a housing, a resilient means on one of said connector halves to axially bias said one half into engagement with the other said half, each said connector half including flange means to limit axial movement of the said halves in the said housing in one direction, and each connector half having snap ring means to limit axial movement in an opposite direction and sleeve means fitted over one of said connector halves including a recess housing said snap ring to assure free radial movement thereof during insertion of said half in said housing.

8. The connector of claim 7 wherein there is provided shroud means on the other said connector half locked to said other half by said snap ring, said shroud means including a radial surface adapted to engage an interior radial surface of said housing means and limit axial displacement in said opposite direction.

9. The connector of claim 8 wherein said shroud means projects from said housing means axially beyond the said other half whereby to engage said one half and assure radial alignment during mating of said connector halves.

* * * * *